US007047606B2

(12) United States Patent
Rivera et al.

(10) Patent No.: US 7,047,606 B2
(45) Date of Patent: May 23, 2006

(54) TWO-SIDED NONWOVEN FABRICS HAVING A THREE-DIMENSIONAL IMAGE

(75) Inventors: Miguel Rivera, Mooresville, NC (US); Ralph A. Moody, III, Mooresville, NC (US); Michael J. Putnam, Fuquay-Varina, NC (US)

(73) Assignee: Polymer Group, Inc., North Charleston, SC (US)

( * ) Notice: Subject to any disclaimer, the term of this patent is extended or adjusted under 35 U.S.C. 154(b) by 0 days.

(21) Appl. No.: 10/400,242

(22) Filed: Mar. 27, 2003

(65) Prior Publication Data

US 2004/0016091 A1 Jan. 29, 2004

Related U.S. Application Data

(60) Provisional application No. 60/370,298, filed on Apr. 5, 2002.

(51) Int. Cl.
*D04H 1/46* (2006.01)

(52) U.S. Cl. ..... 28/104

(58) Field of Classification Search ..... 28/104, 28/105, 106, 103, 163, 167; 442/408, 381, 442/382, 384, 385, 387, 389, 390
See application file for complete search history.

(56) References Cited

U.S. PATENT DOCUMENTS 3,276,944 A 10/1966 Levy
3,338,992 A 8/1967 Kinney
3,341,394 A 9/1967 Kinney
3,485,706 A 12/1969 Evans
3,502,538 A 3/1970 Petersen
3,502,763 A 3/1970 Hartmann
3,509,009 A 4/1970 Hartmann
3,542,615 A 11/1970 Dobo et al.
3,802,980 A 4/1974 Harmon
4,145,468 A 3/1979 Mizoguchi et al.
4,190,695 A 2/1980 Niederhauser
4,636,419 A 1/1987 Madsen et al.
4,808,467 A * 2/1989 Suskind et al. ..... 442/384
5,098,764 A 3/1992 Bassett et al.
5,144,729 A 9/1992 Austin et al.
5,175,042 A * 12/1992 Chomarat ..... 428/139
5,187,005 A 2/1993 Stahle et al.
5,302,446 A 4/1994 Horn
5,334,446 A * 8/1994 Quantrille et al. ..... 442/35
5,475,903 A 12/1995 Collins
5,618,610 A * 4/1997 Tomita et al. ..... 428/152
5,679,379 A 10/1997 Fabbricante et al.

(Continued)

*Primary Examiner*—Amy B. Vanatta
(74) *Attorney, Agent, or Firm*—Wood, Phillips, Katz, Clark & Mortimer

(57) ABSTRACT

The present invention is directed to a method of forming a two-sided nonwoven fabric, which exhibits a pronounced three-dimensional image that is durable to both converting and end-use application. In particular, the present invention contemplates that a fabric is formed from a first precursor web comprising a first fibrous matrix and a second precursor web comprising a second fibrous matrix. Between the first and second precursor web, a fluid-pervious support layer or scrim, is interposed and subjected to hydroentanglement on a moveable imaging surface having a three-dimensional image transfer device. By formation of a nonwoven fabric in this fashion, a three-dimensional image that is durable to abrasion and distortion due to elongation is imparted and a product formed which exhibits on its opposite surfaces the unique properties of the respective fibrous matrix used.

8 Claims, 1 Drawing Sheet

U.S. PATENT DOCUMENTS 6,022,818 A * 2/2000 Welchel et al. ..... 442/384
6,063,717 A 5/2000 Ishiyama et al.
6,114,017 A 9/2000 Fabbricante et al.
6,314,627 B1 11/2001 Ngai
6,550,115 B1 * 4/2003 Skoog et al. ..... 28/104
6,735,832 B1 * 5/2004 Putnam et al. ..... 28/104
2002/0034914 A1 3/2002 De Leon et al.
2003/0009862 A1 * 1/2003 Black et al. ..... 28/104

* cited by examiner

TWO-SIDED NONWOVEN FABRICS HAVING A THREE-DIMENSIONAL IMAGE

TECHNICAL FIELD

The present invention relates generally to methods of making nonwoven fabrics, and more particularly, to a method of manufacturing a two-sided nonwoven fabric exhibiting a three-dimensional image, permitting use of the fabric in a wide variety of consumer applications.

BACKGROUND OF THE INVENTION

The production of conventional textile fabrics is known to be a complex, multi-step process. The production of fabrics from staple fibers begins with the carding process whereby the fibers are opened and aligned into a feedstock referred to in the art as "sliver". Several strands of sliver are then drawn multiple times on a drawing frames to further align the fibers, blend, improve uniformity and reduce the sliver's diameter. The drawn sliver is then fed into a roving frame to produce roving by further reducing its diameter as well as imparting a slight false twist. The roving is then fed into the spinning frame where it is spun into yarn. The yarns are next placed onto a winder where they are transferred into larger packages. The yarn is then ready to be used to create a fabric.

For a woven fabric, the yarns are designated for specific use as warp or fill yarns. The fill yarns (which run on the y-axis and are known as picks) are taken straight to the loom for weaving. The warp yarns (which run on the x-axis and are known as ends) must be further processed. The large packages of yarns are placed onto a warper frame and are wound onto a section beam were they are aligned parallel to each other. The section beam is then fed into a slasher where a size is applied to the yarns to make them stiffer and more abrasion resistant, which is required to withstand the weaving process. The yarns are wound onto a loom beam as they exit the slasher, which is then mounted onto the back of the loom. The warp yarns are threaded through the needles of the loom, which raises and lowers the individual yarns as the filling yarns are interested perpendicular in an interlacing pattern thus weaving the yarns into a fabric. Once the fabric has been woven, it is necessary for it to go through a scouring process to remove the size from the warp yarns before it can be dyed or finished. Currently, commercial high-speed looms operate at a speed of 1000 to 1500 picks per minute, where a pick is the insertion of the filling yarn across the entire width of the fabric. Sheeting and bedding fabrics are typically counts of 80×80 to 200×200, being the ends per inch and picks per inch, respectively. The speed of weaving is determined by how quickly the filling yarns are interlaced into the warp yarns, therefore looms creating bedding fabrics are generally capable of production speeds of 5 inches to 18.75 inches per minute.

In contrast, the production of nonwoven fabrics from staple fibers is known to be more efficient than traditional textile processes, as the fabrics are produced directly from the carding process.

Nonwoven fabrics are suitable for use in a wide variety of applications where the efficiency with which the fabrics can be manufactured provides a significant economic advantage for these fabrics versus traditional textiles. However, nonwoven fabrics have commonly been disadvantaged when fabric properties are compared to conventional textiles, particularly in terms of resistance to elongation, in applications where both transverse and co-linear stresses are encountered. Hydroentangled fabrics have been developed with improved properties, by the formation of complex composite structures in order to provide a necessary level of fabric integrity. Subsequent to entanglement, fabric durability has been further enhanced by the application of binder compositions and/or by thermal stabilization of the entangled fibrous matrix.

Nonwoven composite structures typically improve physical properties, such as elongation, by way of incorporation of a support layer or scrim. The support layer material can comprise an array of polymers, such as polyolefins, polyesters, polyurethanes, polyamides, and combinations thereof, and take the form of a film, fibrous sheeting, or grid-like meshes. Metal screens, fiberglass, and vegetable fibers are also utilized as support layers. The support layer is commonly incorporated either by mechanical or chemical means to provide reinforcement to the composite fabric. Reinforcement layers, also referred to as a "scrim" material, are described in detail in U.S. Pat. No. 4,636,419, which is hereby incorporated by reference. The use of scrim material, more particularly, a spunbond scrim material is known to those skilled in the art.

Spunbond material comprises continuous filaments typically formed by extrusion of thermoplastic resins through a spinneret assembly, creating a plurality of continuous thermoplastic filaments. The filaments are then quenched and drawn, and collected to form a nonwoven web. Spunbond materials have relatively high resistance to elongation and perform well as a reinforcing layer or scrim. U.S. Pat. No. 3,485,706 to Evans, et al., which is hereby incorporated by reference, discloses a continuous filament web with an initial random staple fiber batt mechanically attached via hydroentanglement, with a second random staple fiber batt then attached to the continuous filament web, again, by hydroentanglement. A continuous filament web is also utilized in U.S. Pat. Nos. 5,144,729; 5,187,005; and 4,190,695. These patents include a continuous filament web for reinforcement purposes or to reduce elongation properties of the composite.

More recently, hydroentanglement techniques have been developed which impart images or patterns to the entangled fabric by effecting hydroentanglement on three-dimensional image transfer devices. Such three-dimensional image transfer devices are disclosed in U.S. Pat. No. 5,098,764, which is hereby incorporated by reference; with the use of such image transfer devices being desirable for providing a fabric with enhanced physical properties as well as an aesthetically pleasing appearance.

For specific applications, a two-sided, three-dimensionally imaged nonwoven fabric must exhibit a combination of specific physical characteristics. U.S. Pat. No. 5,302,446 discloses a two-sided nonwoven fabric, however the fabric is ultrasonically bonded and both sides of the fabric are treated with a surfactant so as to render it hydrophilic. The two-sided hydroentangled fabric of the present invention is comprised of at least three layers. The second layer acts as a fiber distribution control layer between the first and third layers wherein the fibrous matrix of the two outer layers may be of the same or different compositions. This construct specifically lends itself useful as a wipe. For example, when the fabric of the present invention is employed in the formation of cleansing wipes, the fabric construct can exhibit sufficient softness for intimate contact with the skin, but also can be capable of exfoliating the skin. Further, the two-sided, three-dimensionally imaged nonwoven fabric is reinforced with a support layer or scrim that is water pervious to ensure effective integration of the construct during hydroentanglement, but able deter the fibers from the first side and from second side of the fabric from becoming extensively intermingled in the production process and yet retain sufficient resistance to delamination.

Notwithstanding various attempts in the prior art to develop a three-dimensionally imaged nonwoven fabric acceptable for home, medical and hygiene applications, a need continues to exist for a nonwoven fabric which provides a pronounced image, as well as the requisite mechanical characteristics.

SUMMARY OF THE INVENTION

The present invention is directed to a method of forming a two-sided nonwoven fabric, which exhibits a pronounced three-dimensional image that is durable to both converting and end-use application. In particular, the present invention contemplates that a fabric is formed from a first precursor web comprising a first fibrous matrix and a second precursor web comprising a second fibrous matrix. Between the first and second precursor web, a fluid-pervious support layer or scrim, is interposed and subjected to hydroentanglement on a moveable imaging surface having a three-dimensional image transfer device. By formation of a nonwoven fabric in this fashion, a three-dimensional image that is durable to abrasion and distortion due to elongation is imparted and a product formed which exhibits on its opposite surfaces the unique properties of the respective fibrous matrix used.

In accordance with the present invention, a method of making a nonwoven fabric embodying the present invention includes the steps of providing a first precursor web comprising a fibrous matrix and a second precursor web comprising a second matrix. While use of staple length fibers is typical, the first and/or second fibrous matrices may comprise substantially continuous filaments. In a particularly preferred form, the first and second fibrous matrices comprise staple length fibers, which are carded and cross-lapped to form precursor webs. In one embodiment of the present invention, the precursor webs are subjected to pre-entangling on a foraminous-forming surface prior to juxtaposition of a support layer or scrim and subsequent three-dimensional imaging. Alternately, one or more layers of fibrous matrix are juxtaposed with one or more support layers or scrims, then the layered construct is pre-entangled to form a precursor web which is imaged directly, or subjected to further fiber, filament, support layers, or scrim layers prior to imaging.

In a first embodiment, the fabric has a first side or surface comprised of a first fibrous matrix and a second side or surface comprised of a second fibrous matrix, wherein said first and second fibrous matrix are dissimilar. Further, the first and second sides are separated by an intermediate water pervious, fiber distribution control layer, which acts to deter the excessive intermingling of the first fibrous matrix and second fibrous matrix.

In a second embodiment, the fabric further includes apertures wherein the apertures may extend partially or entirely through one or more of the component layers.

In a third embodiment, the fibrous constituent of the first fibrous matrix and the second fibrous matrix exhibit a by fiber modulus difference of at least 10%, wherein the fibrous matrix with the lower fiber modulus comes in contact with the three-dimensional imaging transfer device. For example, if the first side is comprised of a first fibrous matrix comprising a 1.2 dpf fiber and the second side is comprised of a second fibrous matrix comprising a 15 dpf fiber, then the first side would become the side that comes in contact with the three-dimensional imaging transfer device.

The first and second precursor webs, with an interposed fiber distribution control layer, are advanced onto the imaging surface of the image transfer device. Hydroentanglement of the precursor web is affected to form a three-dimensionally imaged fabric. Significantly, the incorporation of a fiber distribution control layer acts to limit the ability of the fibrous constituent of the first precursor web and the second precursor web from becoming extensively intermixed, and yet results in a nonwoven fabric that exhibits sufficient resistance to delamination.

Subsequent to hydroentanglement, the three-dimensionally imaged fabric may be subjected to one or more variety of post-entanglement treatments. Such treatments may include application of a polymeric binder composition, mechanical compacting, application of surfactant or electrostatic compositions, and like processes.

In the preferred form, the precursor webs are hydroentangled on a foraminous surface prior to hydroentangling on the image transfer device. This pre-entangling of the precursor web acts to integrate the fibrous components of the web, but does not impart a three-dimensional image as can be achieved through the use of the three-dimensional image transfer device.

Optionally, subsequent to three-dimensional imaging, the imaged nonwoven fabric can be treated with a performance or aesthetic modifying composition to further alter the fabric structure or to meet end-use article requirements. A polymeric binder composition can be selected to enhance durability characteristics of the fabric, while maintaining the desired softness and drapeability of the three-dimensionally imaged fabric. A surfactant can be applied so as to impart hydrophilic properties. In addition, electrostatic modifying compound can be used to aid in cleaning or dusting applications.

Other features and advantages of the present invention will become readily apparent from the following detailed description, the accompanying drawings, and the appended claims.

DETAILED DESCRIPTION

Figure 1:
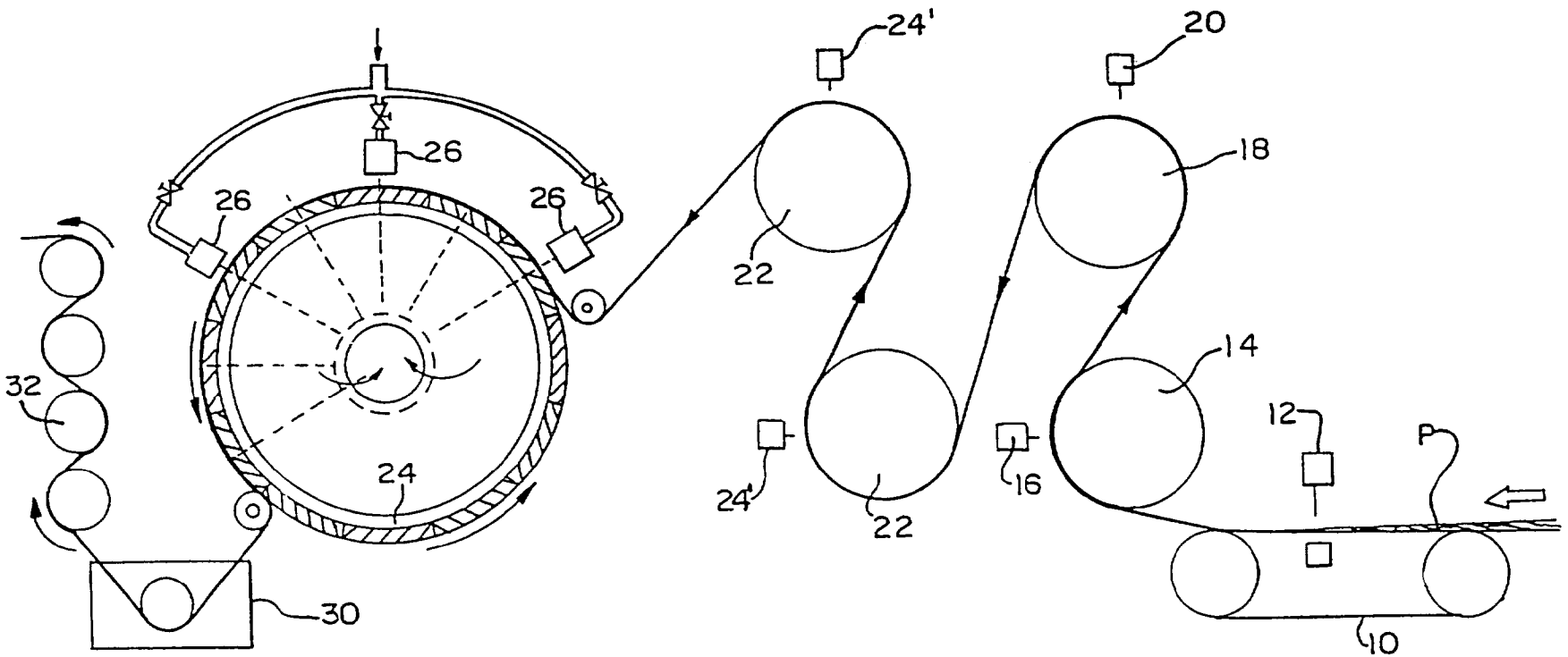
FIG. 1 is a diagrammatic view of an apparatus for manufacturing a durable nonwoven fabric, embodying the principles of the present invention.

While the present invention is susceptible of embodiment in various forms, there is shown in the drawings, and will hereinafter be described, a presently preferred embodiment of the invention, with the understanding that the present disclosure is to be considered as an exemplification of the invention, and is not intended to limit the invention to the specific embodiment illustrated.

The present invention is directed to a method of forming two-sided nonwoven fabrics by hydroentanglement, wherein three-dimensional imaging of the fabrics is enhanced and a fiber distribution control layer put into place between the two sides by the incorporation of at least one fluid-pervious support layer or scrim. Enhanced imaging can be achieved utilizing various techniques, one such technique involves minimizing and eliminating tension in the overall precursor web as the web is advanced onto a moveable imaging surface of the image transfer device, as represented by co-pending U.S. patent application Ser. No. 60/344,259, to Putnam et al, entitled *Nonwoven Fabrics Having a Durable Three-Dimensional Image,* and filed on Dec. 28, 2001, which is hereby incorporated by reference. The use of a support layer or scrim benefits the fabric of the present invention providing a median fiber distribution control layer wherein the support layer deters the fibrous constituents of the two outer layers from becoming excessively intermingled with one another. The incorporation of a support layer improves the overall performance of the two-sided fabric by providing a three-dimensionally imaged nonwoven fabric that exhibits a pronounced difference in surface performance properties inherent to the fibrous matrix used.

A method of making the present two-sided, three-dimensionally imaged nonwoven fabric comprises the steps of providing at least a first precursor web comprised of a first fibrous matrix and a second precursor web comprising a second fibrous matrix and a median support layer or scrim to act as the fiber distribution control layer, which is subjected to hydroentangling. The precursor webs are formed into a three-dimensionally imaged nonwoven fabric by hydroentanglement on a three-dimensional image transfer device. The image transfer device defines three-dimensional elements against the precursor web whereby the first fibrous matrix is displaced into the three-dimensional topography while the second fibrous matrix is significantly retained on the side away from the three-dimensional topography forced during hydroentanglement.

With reference to FIG. 1, therein is illustrated an apparatus for practicing the present method for forming a nonwoven fabric. The fabric is formed from a fibrous matrix, which typically comprises staple length fibers, but may comprise substantially continuous filaments. The fibrous matrix is preferably carded and cross-lapped to form a fibrous batt, designated F. In a current embodiment, the fibrous batt comprises 100% cross-lap fibers, that is, all of the fibers of the web have been formed by cross-lapping a carded web so that the fibers are oriented at an angle relative to the machine direction of the resultant web. U.S. Pat. No. 5,475,903, hereby incorporated by reference, illustrates a web drafting apparatus.

A support layer or scrim is then placed in face to face to face juxtaposition with a first fibrous web and hydroentangled to form precursor web P. Alternately, the fibrous web can be hydroentangled first to form precursor web P, and subsequently, at least one support layer or scrim is applied to the precursor web, and the composite construct optionally further entangled with non-imaging hydraulic manifolds, then imparted with a three-dimensional image on an image transfer device.

FIG. 1 illustrates a hydroentangling apparatus for forming nonwoven fabrics in accordance with the present invention. The apparatus includes a foraminous-forming surface in the form of belt 10 upon which the precursor web P is positioned for pre-entangling by entangling manifold 12. Pre-entangling of the precursor web, prior to three-dimensional imaging, is subsequently effected by movement of the web P sequentially over a drum 14 having a foraminous-forming surface, with entangling manifold 16 effecting entanglement of the web. Further entanglement of the web is effected on the foraminous forming surface of a drum 18 by entanglement manifold 20, with the web subsequently passed over successive foraminous drums 20, for successive entangling treatment by entangling manifolds 24', 24'.

The entangling apparatus of FIG. 1 further includes a three-dimensional imaging transfer device 24 comprising a three-dimensional image transfer device for effecting imaging of the now-entangled precursor web. The image transfer device includes a moveable imaging surface which moves relative to a plurality of entangling manifolds 26 which act in cooperation with three-dimensional elements defined by the imaging surface of the image transfer device to effect imaging and patterning of the fabric being formed.

The present invention contemplates that the fluid-pervious support layer or scrim be any such suitable material, including, but not limited to, wovens, knits, open mesh scrims, and/or nonwoven fabrics, which exhibit low elongation performance. Two particular nonwoven fabrics of particular benefit are spunbond fabrics, as represented by U.S. Pat. Nos. 3,338,992, 3,341,394. 3,276,944, 3,502,538, 3,502,763, 3,509,009; 3,542,615; and Canadian Patent No. 803,714, these patents are incorporated by reference, and nanofiber fabrics as represented by U.S. Pat. Nos. 5,678,379 and 6,114,017, both incorporated herein by reference. A particularly preferred embodiment of support layer or scrim is a thermoplastic spunbond nonwoven fabric. The support layer may be maintained in a wound roll form, which is then continuously fed into the formation of the precursor web, and/or supplied by a direct spinning beam located in advance of the three-dimensional imaging drum 24.

Manufacture of a durable nonwoven fabric embodying the principles of the present invention is initiated by providing the fibrous matrix, which can include the use of staple length fibers, continuous filaments, and the blends of fibers and/or filaments having the same or different composition. Fibers and/or filaments are selected from natural or synthetic composition, of homogeneous or mixed fiber length. Suitable natural fibers include, but are not limited to, cotton, wood pulp and viscose rayon. Synthetic fibers, which may be blended in whole or part, include thermoplastic and thermoset polymers. Thermoplastic polymers suitable for blending with dispersant thermoplastic resins include polyolefins, polyamides and polyesters. The thermoplastic polymers may be further selected from homopolymers; copolymers, conjugates and other derivatives including those thermoplastic polymers having incorporated melt additives or surface-active agents. Staple lengths are selected in the range of 0.25 inch to 10 inches, the range of 1 to 3 inches being preferred and the fiber denier selected in the range of 1 to 22, the range of 2.0 to 20 denier being preferred for general applications. The profile of the fiber and/or filament is not a limitation to the applicability of the present invention.

Using a forming apparatus as illustrated in FIG. 1, a nonwoven fabric was made in accordance with the present invention by providing a layered precursor web comprised of differing fiber compositions. In a preferred embodiment, a layered precursor web comprising a first side comprising layers including a first fibrous matrix blend of 85%, 1.2 dpf polyester, made commercially available as Wellman Type 472, and 15%, 2.0 dpf low melt bicomponent fiber, commercially available as Stein Type 131-00251S, and a second layer blend of 90%, 1.2 dpf polyester fiber and 10% rayon fiber, made commercially available as Lenzing 8192. The precursor web included a median layer of 0.50 os/y$^2$ of polypropylene spunbond, and a second side comprising a second fibrous matrix blend of 50%, 3 dpf polyester and 50% 15 dpf polyester. The first side, comprised of the first fibrous matrix comprising 1.2 dpf fibers was placed in contact with the three-dimensional imaging transfer device. The image transfer device defines three-dimensional elements against the precursor web whereby the first fibrous matrix is displaced into the three-dimensional topography while the second fibrous matrix is significantly retained on the side away from the three-dimensional topography forced during hydroentanglement. Such a construct, allows for a soft side comprised of fine denier fibers wherein upon imaging, the fine fibers perform so as to provide a pronounced imaged. The spunbond layer incorporated therein acts to separate the aforementioned three-dimensionally imaged side from the courser side, which is comprised of a larger fiber.

Optionally, the fabric of the present invention may comprise apertures. The apertures may be of various shapes and sizes while spaces equal distances from one another or randomly distributed throughout the resultant fabric. Further, the apertures may extend through one or more layers of the fabric.

The material of the present invention may be utilized in the construction of a numerous home cleaning, personal hygiene, medical, and other end use products where a three-dimensionally imaged nonwoven fabric can be employed. Disposable absorbent hygiene articles, such as a sanitary napkins, incontinence pads, diapers, and the like, wherein the term "diaper" refers to an absorbent article generally worn by infants and incontinent persons that is worn about the lower torso of the wearer can benefit from the improved resiliency of the imaged nonwoven in the absorbent layer construction. An imaged nonwoven fabric may also be utilized as a landing zone affixed to the disposable absorbent article whereby the distal end of a fastening strip may attach; the imaged nonwoven fabric exhibiting improved "loop" durability and fuzz resistance to repeated, or finite, "hook" attachment cycles. In addition, the material may be utilized as medical gauze, or similar absorbent surgical materials, for absorbing wound exudates and assisting in the removal of seepage from surgical sites. Other end uses include; fabrication into wet or dry facial or hard surface wipes, which can be readily hand-held for cleaning and the like, protective wear for medical and industrial uses, such as gowns, shirts, bottom weights, lab coats, face masks, and the like, and protective covers, including covers for vehicles such as cars, trucks, boats, airplanes, motorcycles, bicycles, golf carts, as well as covers for equipment often left outdoors like grills, yard and garden equipment, such as mowers and roto-tillers, lawn furniture, floor coverings, table cloths and picnic area covers. The material may also be used in apparel construction, such as for bottom weights of every day wear, which includes pants and shorts.

From the foregoing, it will be observed that numerous modifications and variations can be affected without departing from the true spirit and scope of the novel concept of the present invention. It is to be understood that no limitation with respect to the specific embodiments illustrated herein is intended or should be inferred. The disclosure is intended to cover, by the appended claims, all such modifications as fall within the scope of the claims.

What is claimed is:

1. A method of making a two-sided, imaged nonwoven fabric, comprising the steps of:

providing at least a first nonwoven fibrous matrix and a second nonwoven fibrous matrix, wherein said first fibrous matrix is dissimilar to said second fibrous matrix;

providing a fiber distribution control layer selected from the group consisting of scrims, woven fabrics, knit fabrics, open grid meshes, and spunbond nonwoven fabrics;

providing a three-dimensional image transfer device having a movable imaging surface;

positioning said fiber distribution control layer between said first and second fibrous matrices and applying hydraulic energy to entangle said fibrous matrices and said fiber distribution control layer into a precursor web;

advancing said precursor web onto said image transfer device so that said web moves with said imaging surface; and hydroentangling said precursor web on said image transfer device to form a three-dimensionally imaged nonwoven fabric.

2. A method of making a two-sided, imaged nonwoven fabric in accordance with claim 1, wherein said first fibrous matrix comprises staple length fibers.

3. A method of making a two-sided, imaged nonwoven fabric in accordance with claim 1, wherein said second fibrous matrix comprises staple length fibers.

4. A method of making a two-sided, imaged nonwoven fabric in accordance with claim 1, wherein said first fibrous matrix comprises substantially continuous filaments.

5. A method of making a two-sided, imaged nonwoven fabric in accordance with claim 1, wherein said fiber distribution control layer is a scrim.

6. A method of making a two-sided imaged nonwoven fabric in accordance with claim 1, wherein:

said first fibrous matrix comprises fibers having an average denier less than an average denier of fibers of said second fibrous layer, said hydroentangling step including positioning said precursor web on said image transfer device so that fibers of said first fibrous layer forming said precursor web are positioned adjacent the image transfer device.

7. A method of making a two-sided, imaged nonwoven fabric, comprising the steps of:

providing at least a first nonwoven fibrous matrix and a second nonwoven fibrous matrix, wherein said first fibrous matrix is dissimilar to said second fibrous matrix;

providing a fiber distribution control layer selected from the group consisting of scrims, woven fabrics, knit fabrics, open grid meshes, and spunbond nonwoven fabrics;

providing a three-dimensional image transfer device having a movable imaging surface;

juxtaposing said fiber distribution control layer in a face-to-face relationship with said first fibrous matrix and applying hydraulic energy to entangle said first fibrous matrix and said fiber distribution control layer into a precursor web;

applying said second fibrous matrix and advancing said second fibrous matrix and said precursor web onto said image transfer device so that said web moves with said imaging surface; and hydroentangling said second fibrous matrix and said precursor web on said image transfer device to form a three-dimensionally imaged nonwoven fabric.

8. A method of making a two-sided, nonwoven fabric, comprising the steps of:

providing at least a first fibrous matrix and a second fibrous matrix, wherein said first fibrous matrix is dissimilar to said second fibrous matrix;

providing a fibrous distribution control layer selected from the group consisting of scrims, woven fabrics, knit fabrics, open grid meshes, and spunbond nonwoven fabrics;

carding and cross-lapping said fibrous matrices;

positioning said fibrous distribution control layer between said fibrous matrices to form a precursor web;

entangling said precursor web on a foraminous forming surface;

providing a three-dimensional image transfer device comprising an imaging surface having an array of three-dimensional surface elements, said imaging surface being movable relative to at least one associated hydroentangling manifold; and hydroentangling said precursor web on said imaging surface so that portions of said precursor web are displaced from on top of said three-dimensional surface elements to form an imaged and patterned nonwoven fabric.

* * * * *